US006634998B2

(12) United States Patent
Siaperas

(10) Patent No.: US 6,634,998 B2
(45) Date of Patent: Oct. 21, 2003

(54) MULTIPURPOSE EXERCISE APPARATUS

(76) Inventor: Matt Siaperas, 5016 Apache Ave., Pocatello, ID (US) 83201

( * ) Notice: Subject to any disclaimer, the term of this patent is extended or adjusted under 35 U.S.C. 154(b) by 236 days.

(21) Appl. No.: 09/877,176

(22) Filed: Jun. 11, 2001

(65) Prior Publication Data

US 2001/0027151 A1 Oct. 4, 2001

Related U.S. Application Data

(63) Continuation-in-part of application No. 09/379,925, filed on Aug. 24, 1999, now Pat. No. 6,245,001.

(51) Int. Cl.[7] ..... A63B 21/00
(52) U.S. Cl. ..... 482/142; 482/123; 482/129
(58) Field of Search ..... 482/142, 126, 482/130, 907, 904, 121, 123, 52, 92

(56) References Cited

U.S. PATENT DOCUMENTS 2,676,015 A * 4/1954 Courtney ..... 482/142
3,664,666 A * 5/1972 Lloyd ..... 482/142
4,198,044 A * 4/1980 Holappa ..... 482/142
4,492,376 A * 1/1985 Schatz et al. ..... 482/142
5,542,898 A * 8/1996 Wilkinson ..... 482/142
5,575,742 A * 11/1996 Wu ..... 482/92
5,697,870 A * 12/1997 Osborn ..... 482/52

* cited by examiner

*Primary Examiner*—Jerome W. Donnelly
(74) *Attorney, Agent, or Firm*—Tom Hamill, Jr.

(57) ABSTRACT

A multi-purpose exercise device is disclosed. The device is generally an elongated rectangular box with a top side, a bottom side, a right side, a left side, a front side and a back side. The box tapers from the topside to the bottom side, giving it a trapezoidal configuration. The top side includes a transverse hinge forming a first adjustable section and a second adjustable section. The first section may be rotated about the hinge and be fixed at various angles by a pivotal adjustment arm. The second section may also be rotated about the hinge and may be secured in an angular position by a seat riser. The interior under the first section holds specialty bars, a wheel, a body pad and a variety of other devices. The interior under the second section holds handles, ankle straps, kneepads, cable ties, elastic elements and the like. A plurality of color coded ring clips are present on the right side, the left side, the front side and the back side. The underside of the first section has vertical sidewalls which would nest inside the interior under the first section. These vertical sidewalls will also have color coded ring clips. A variety of elastic members are secured to a carabineer on a first side. The caribiner is attached to a trigger clip which in turn would be clipped to an appropriate ring clip. The second side of the elastic member is attached to a handle. A variety of exercises can therefore be performed.

15 Claims, 6 Drawing Sheets

FIG.9
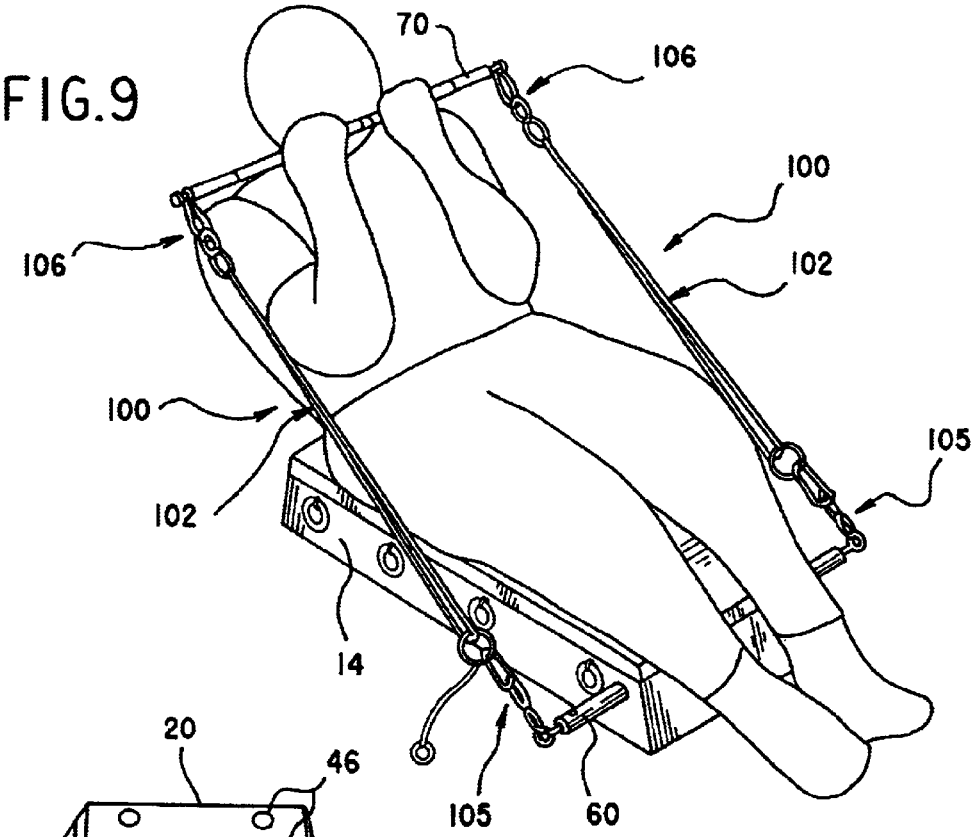
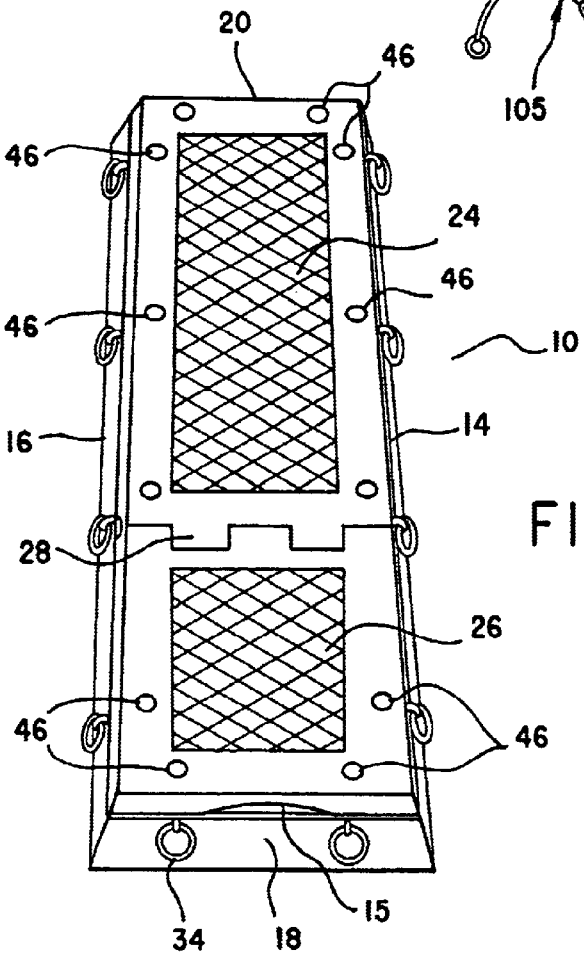
FIG.8

MULTIPURPOSE EXERCISE APPARATUS

This application is a Continuation-in-Part of U.S. patent application Ser. No. 09/379,925 entitled "Multi-purpose Exercise Apparatus" filed on Aug. 24, 1999, now U.S. Pat. No. 6,245,001.

BACKGROUND OF THE INVENTION

1. Field of the Invention

The present invention relates generally to exercise equipment, and more particularly, to a multipurpose apparatus that allows the user to perform a variety of exercises permitting a more entertaining, varied and productive workout. More specifically, the invention related to a portable exercise device that includes resistive elements removably attached to the body of the device. Even more specifically, the invention related to exercise devices where the resistive elements may be attached at a plurality of locations on the body of the device.

2. Description of the Prior Art

The instant invention includes distinct new structural enhancements to the earlier version of the "Multipurpose Exercise Apparatus". These include, but are not limited to, the hinge configuration, the addition of bar elements and apertures, additional color coding features, the addition of a non-slip surface, storage areas, body pad, hand grips and the like. These new features convey advantages over the earlier version of this invention. Other advantages of the present invention over the previous invention as well as over other exercise equipment will be rendered evident.

SUMMARY OF THE INVENTION

The present invention is a multi-purpose exercise device. The device is generally an elongated rectangular box with a top side, a bottom side, a right side, a left side, a front side and a back side. The box tapers from the topside to the bottom side, giving it a trapezoidal configuration. The top side includes a transverse hinge forming a first adjustable section and a second adjustable section. The first section may be rotated about the hinge and be fixed at various angles by a pivotal adjustment arm. The first section is also known as the upper deck or front deck. The second section may be referred to as the rear deck. The front deck is secured to the front side by a carriage pin. The upper deck has a top side and a bottom side. The top side of the upper deck includes a non-stick surface. When the first carriage pin is removed, the upper deck may be rotated about the hinge, permitting access to a first area.

The front deck bottom side has a plurality of receiving apertures centrally disposed thereon. Further, the upper deck bottom side has vertical sidewalls perpendicular to the deck and defining the upper deck bottom side's perimeter. The vertical sidewalls have an outer face to which a plurality of color coded ring clips are disposed. The plurality of color coded ring clips are recessed into the outer face of the vertical sidewalls. The vertical sidewalls further nest within the right side, the left side and the front side. The right vertical sidewall and the left vertical sidewall have a first and second aperture respectively which are designed to receive either the combar or the extension bar therethrough. This can occur when the upper deck is in an angled relation or when the upper deck laying flat, with the vertical sidewalls nested.

The first area includes a bar whose first side is hingedly attached to the interior of the bottom side. The bar's second side is designed to be received in any one of the plurality of apertures located on the upper deck's bottom side. This keeps the upper deck open at any one of a variety of angles. The first area also stores a variety of equipment. A first bar called a combar and a second bar called an extension bar are secured in the first area. A wheel to be used with the combar is secured in the first area. A mat made of an elastomeric foam material is also located in the first area. The combar, extension bar and wheel are utilized to perform a variety of exercises which will be discussed later.

The second section may also be rotated about the hinge and may be secured in an angular position by a seat riser. The second section is also known as the seat. The seat is secured to the back side by a second carriage pin. When the first and second carriage pins are removed, they are designed to be placed on the end of the extension bar. The second interior area located under the second section holds a power harness, cable ties and elastic elements.

A plurality of color coded ring clips are present on the right side, the left side, the front side and the back side of the device. These color coded ring clips are recessed as well and reside on the tapered sidewalls. The color coded ring clips are designed to be connected to the power harness. A plurality of other color coded elements are located atop the front deck and the rear deck.

The power harness includes a handle, a plurality of elastic elements, a carabineer and a trigger clip. The elastic elements are conventionally secured intermediate the handle and the carabineer. The carabineer in turn is affixed to the trigger clip. The trigger clip easily affixes to any of the plurality of ring clips located on the device. A variety of exercises can therefore be performed by using one or both power harnesses. The overall system, method and apparatus is known as the "Target Trainer".

The above brief description sets forth rather broadly the more important features of the present invention in order that the detailed description thereof that follows may be better understood, and in order that the present contributions to the art may be better appreciated. There are, of course, additional features of the invention that will be described hereinafter and which will form the subject matter of the claims appended hereto.

In this respect, before explaining the invention in detail, it is to be understood that the invention is not limited in its application to the details of the construction and to the arrangements of the components set forth in the following description or illustrated in the drawings. The invention is capable of other embodiments and of being practiced and carried out in various ways. Also, it is to be understood, that the phraseology and terminology employed herein are for the purpose of description and should not be regarded as limiting.

As such, those skilled in the art will appreciate that the conception, upon which this disclosure is based, may readily be utilized as a basis for designing other structures, methods, and systems for carrying out the several purposes of the present invention. It is important, therefore, that the claims be regarded as including such equivalent constructions insofar as they do not depart from the spirit and scope of the present invention.

It is therefore an object of the present invention to provide a multipurpose exercise device which includes resistive elements which are affixed to any of a plurality of ring clips, permitting any of a variety of exercises to be performed.

It is an object of the present invention to provide a multipurpose exercise device wherein the ring clips are mounted in a recessed fashion.

It is an object of the present invention to provide a multipurpose exercise device in which the recesses are color coded which permits ease of instruction in both written and video form of various exercises.

It is an object of the present invention to provide a multipurpose exercise device which has a generally box-like trapezoidal configuration, which prevents the ring clips and the colored recesses from coming into contact with the wall.

It is an object of the present invention wherein the multipurpose exercise device includes a hinge which permits a seat portion and a back supporting portion (deck) to rotate thereabout.

It is an object of the present invention wherein the multipurpose exercise device wherein the deck has a plurality of depending sidewalls which nest within the outer trapezoidal box.

It is an object of the present invention wherein the multipurpose exercise device includes a storage area under the back supporting portion (deck).

It is an object of the present invention to provide a variety of exercise accessories which are stored in the storage area, including, but not limited to, a wheel, a combar, an extension bar, a foam pad, leg and ankle attachment devices, a variety of resistive extension elements, handles, carabineer attachment clips, other clips and the like.

These together with still other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated herein.

BRIEF DESCRIPTION OF THE DRAWINGS

The invention will be better understood and the above objects as well as objects other than those set forth above will become more apparent after a study of the following detailed description thereof. Such description makes reference to the annexed drawings wherein:

FIG. 8 shows the multipurpose exercise apparatus with both the front deck and the rear deck in a closed and secured position.

FIG. 9 shows a user performing an exercise involving the extension bar and the power harness.

DESCRIPTION OF THE PREFERRED EMBODIMENT

Figure 1:
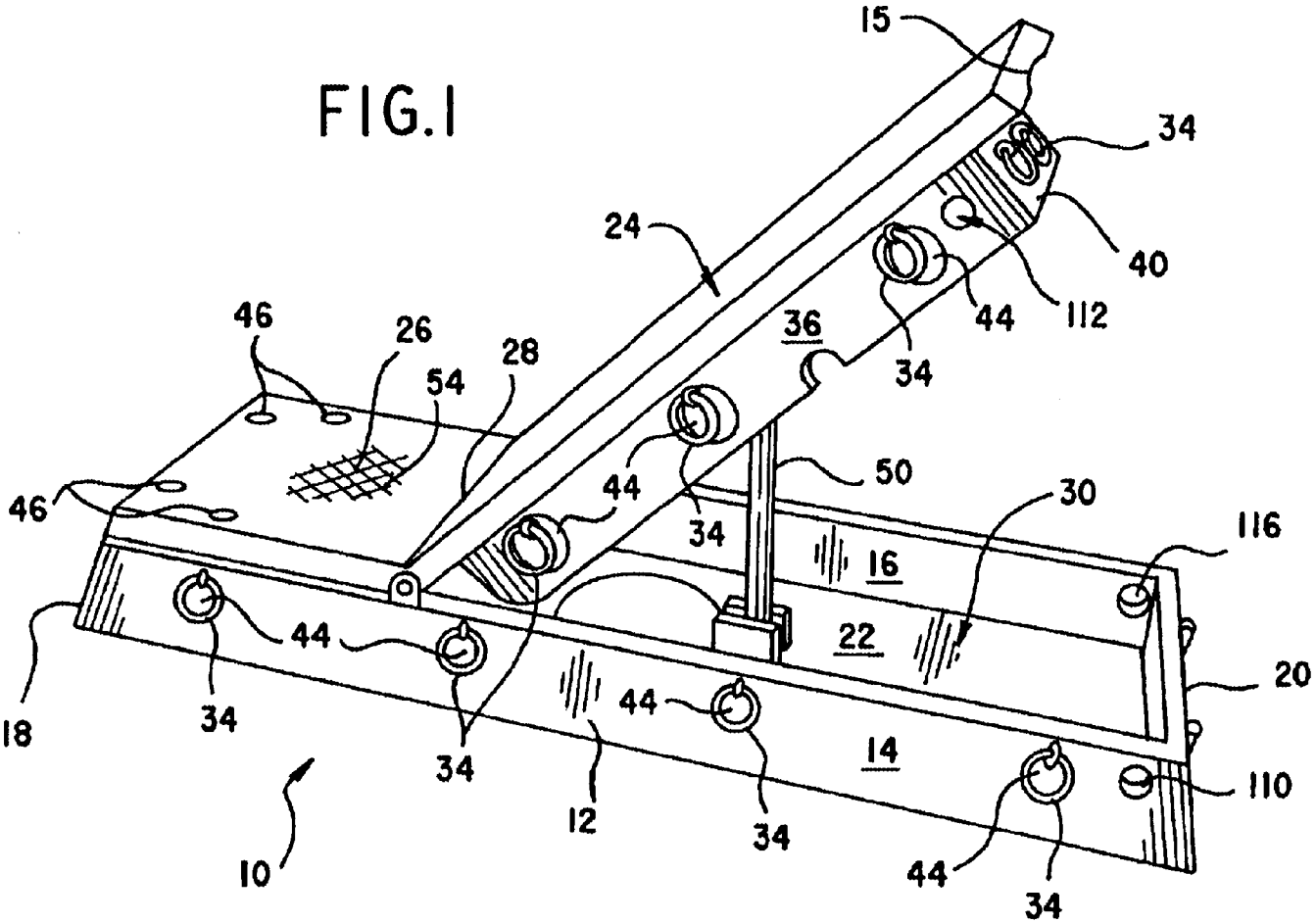
FIG. 1 is a perspective view showing the multipurpose exercise apparatus with it's front deck open.

Turning initially to FIGS. 1, 1A, 2 and 3 the multipurpose exercise apparatus 10 and its accouterments are shown. The multipurpose exercise apparatus 10 is a generally trapezoidal box like body 12.

The multipurpose exercise apparatus 10 is known as the Target Trainer as it targets individual muscles for workout. It may come in a variety of sizes to accommodate people with different physiques and ages.

The box-like body 12 has a right side 14, a left side 16, a back side 18, a front side 20, and a bottom side 22. The bottom side 22 which coacts with the floor may have a non-slip surface. The top side is comprised of a front deck 24 and a rear deck 26 which are connected by a hinge 28. The front deck 24 and the rear deck 26 independently rotate about the hinge 28. The rear deck 26 generally acts as a seat for the user and the front deck 24 would generally support the back of the user although other configurations are possible. The hinge 28 marks a separation in the interior of the box like body 12 between a forward storage area 30 and a rear storage area 32. The front deck 24 includes a handle or a cutout 15 to permit ease of openings. A handle for carrying the multipurpose exercise apparatus 10 may be located on the right side 14 or the left side 16. For ergonomic purposes the handle should be centrally located and may be padded.

Figure 1A:
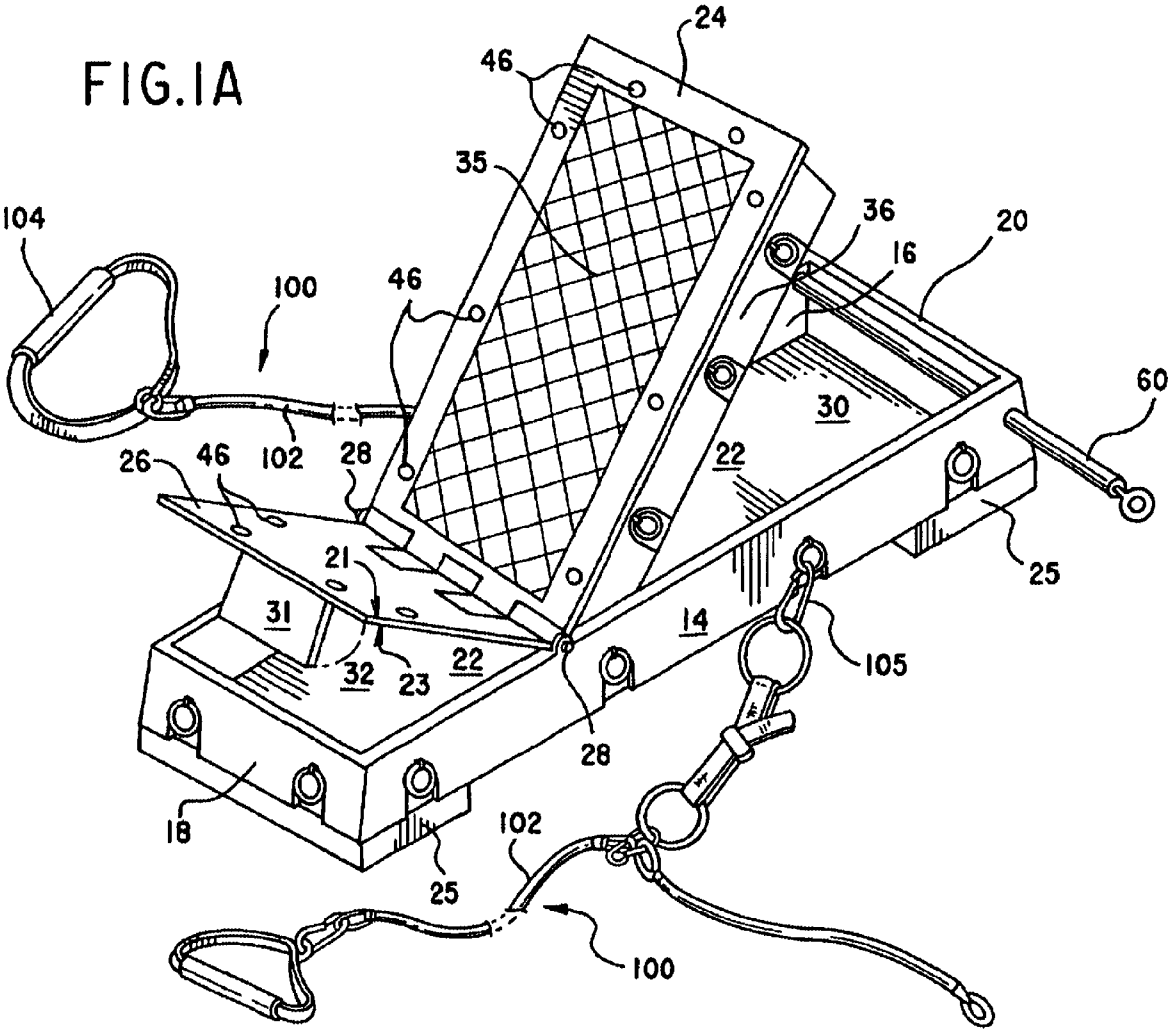
FIG. 1A is a second perspective view of the multipurpose exercise apparatus with both the front and rear decks in the open position.

The rear storage area 32 is located below the rear deck 26. Access to the rear storage area 32 is provided by lifting the rear deck 26 which rotates about the hinge 28. A seat riser 31 is located below the rear deck 26. The seat riser 31 permits the rear deck 26 to be maintained open at an angle as best seen in FIG. 1A. The rear storage area 32 may store any of the accouterments which accompany the multipurpose exercise apparatus 10. This includes straps and other devices which may permit the elastic resistance elements 102 to be affixed to a human leg, arm, neck, head or the like.

The front deck 24 includes a upper side 35, a lower side 37 and a perimeter 39. The front deck 24 lower side 37 includes an inside right side 36, an inside left side 38 and an inside front side 40 which are oriented perpendicularly about the perimeter 39 and nest within the forward storage area 30.

The right side 14, the left side 16, the back side 18, the front side 20, the inside right side 36, the inside left side 38 and the inside front side 40 all have an outwardly facing surface and an inwardly facing surface. The outwardly facing surface of all of the aforementioned side elements have a plurality of ring clips 34 mounted thereon at discrete intervals from each other. Each ring clip 34 is recessed 44 into the outwardly facing surface of the right side 14, the left side 16, the back side 18, the front side 20, the inside right side 36, the inside left side 38 and the inside front side 40. The ring clips 34 on the outside sides, ie: the right side 14, the left side 16, the back side 18 and the front side 20 are on a sloped surface due to the trapezoidal configuration of the multipurpose exercise apparatus 10.

The recesses 44 are color coded according to their position. The ring clips 34 are designed to have a power harness 100 attached thereto. The power harness 100 has an attachment means 105 for attaching the harness 100 to the ring clip 34, a resistance element 102, and a handle portion 104. The mechanical configuration of the power harness 100 will be discussed in the description of FIG. 7.

The ring clips 34 are generally circular and are affixed in such a manner to the sides so that they may rotate out of the recesses. They have a wide range of motion. Other means to attach the power harness 100 may be provided. Any mechanical element which has sufficient material properties (tensile strength, elasticity, etc) and a portion which a carabineer, clip, or other attachment means may affix to could be employed.

The color coding is used with an instruction manual or the like to aid the user in performing different exercises.

The right side 14 is chosen to have four ring clips thereon, the four ring clips being equidistant. The left side is chosen to have four ring clips thereon, the four ring clips again being equidistant. The ring clips on the right side 14 are co-linear with the ring clips on the left side 16. Additionally, the inside right side 36 is chosen to have three ring clips thereon, the three ring clips being equidistant. The inside left side 38 also is chosen to have three ring clips thereon, the three ring clips again being equidistant. The ring clips on the inside right side 36 are co-linear with the ring clips on the inside left side 38. The back side 18 is chosen to have two ring clips thereon. The front side 20 is chosen to have two ring clips. The inside front side 40 is also chosen to have two ring clips.

Each ring clip is associated with a recess 44 and each recess has a color associated with it.

The recesses 44 on the back side 18 are chosen to both be a first color. The recesses 44 on the front side 20 are chosen to be a second color. The recesses 44 on the inside front side 40 are chosen to be a third color. It has been considered that the colors located on the recesses 44 of the back side 18, the front side 20, and the inside front side 40 may be different colors.

The right side 14 and the left side 16 each have four ring clips. Each ring clip which is the right side 14 is directly across from or co-linear with the ring clip on the left side 16. Each one of the co-linear pairs of ring clips are a different color. Starting from the back side 18 and going to the front side 20 gives us the following. Since there are four ring clips, there is a fourth color associated with the first pair of ring clips, a fifth color with the second pair of ring clips, a sixth color with the third pair of ring clips, and a seventh color associated with the fourth pair of ring clips.

The inner right side 36 and the inner left side 38 each have three ring clips. Each ring clip which is on the inner right side 36 is directly across from or co-linear with the ring clip on the inner left side 38. Again, each one of the co-linear pairs of ring clips are a different color. Starting from the hinge 28 and going to the inside front side 40 gives us the following. Since there are three additional pairs of ring clips located here, there is an eighth color associated with the fifth pair of ring clips, a ninth color associated with the sixth pair of ring clips, and a tenth color associated with the seventh pair of ring clips. The colors which may be used may be, but are not limited to, red, yellow, green, blue, orange, and white. By affixing the power harness 100 to any of a variety of color coded clip rings 34 a very wide range of exercises may be performed.

The rear deck 26 has an upper side 21 and a lower side 23. A plurality of color coded elements 46 are provided on the upper side 21. The color coded elements 46 are the same color as the ring clip recesses which are closest to the color coded elements 46. Therefore the pair of color coded elements closest to the back side 18 are also a first color. The pair of color coded elements closest to the right side 14 and the left side 16 are a fourth color.

The front deck 24 has an upper side 35 and a lower side 37. A plurality of color coded elements 46 are provided on the upper side 35. The color coded elements 46 are the same color as the ring clip recesses which are closest to the color coded elements 46.

The plurality of color coded elements 46 located on the front deck 24 and the rear deck 26 permits the user to know where to hook up the power harness 100 as well as where to place their feet when doing step style or other exercises.

The front deck 24 may be held in any of a plurality of upright positions by bar 50. The front deck 24 lower side 37 has a plurality of apertures 52 centrally disposed thereon which receive an end portion of bar 50. Apertures 52 are color coded as well, as different exercises are performed when the front deck 24 is at different angles. In this fashion, the front deck 24 may be held in any of a variety of angles with respect to the rear deck 26. Bar 50 is pivotable and resides in the forward storage area 30. Both the upper side 21 of the rear deck 26 and the upper side 35 of the front deck 24 has a textured surface 54.

Figure 2:
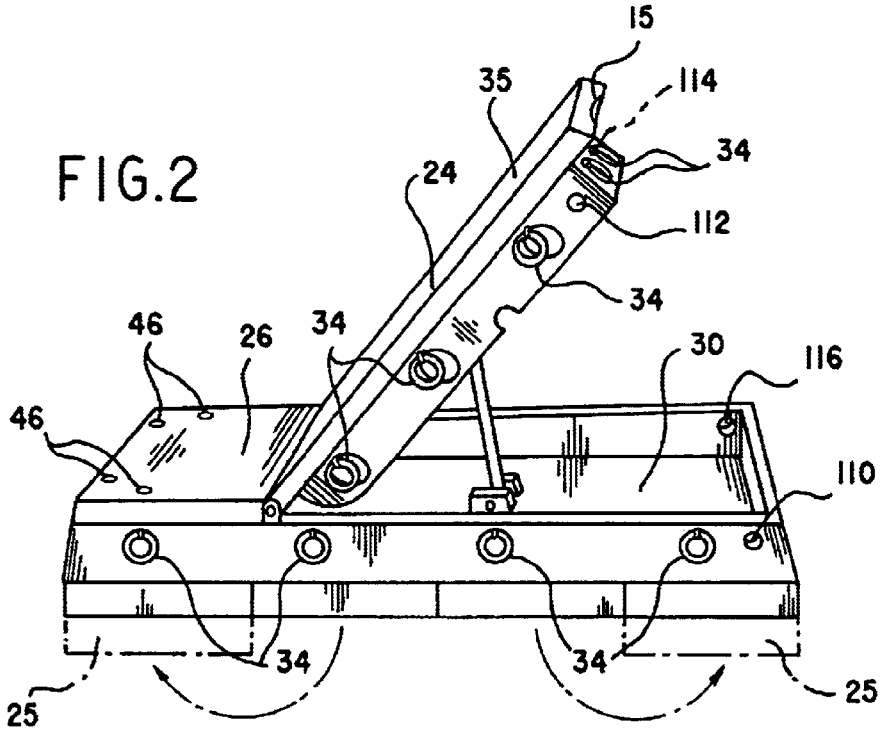
FIG. 2 is a side view of the multipurpose exercise apparatus with the front deck open.
Figure 3:
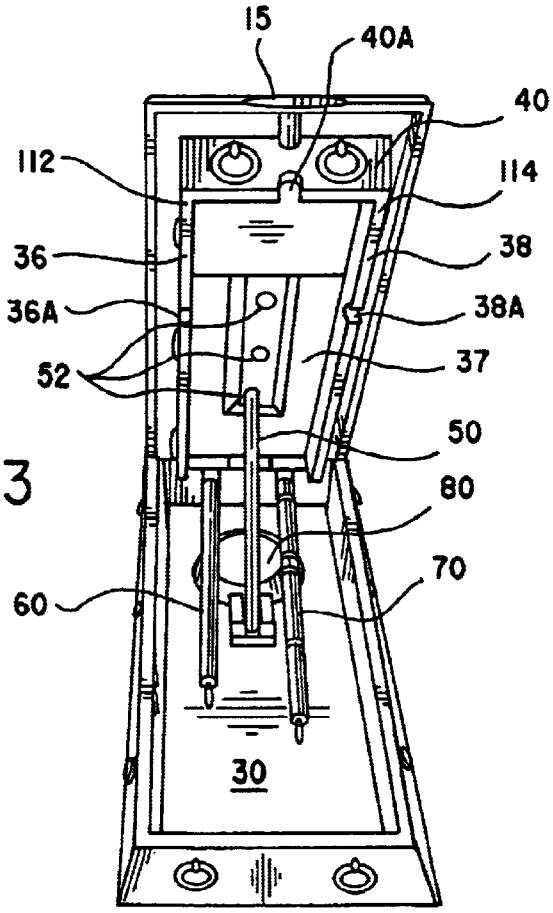
FIG. 3 is a view of the multipurpose exercise apparatus showing the front storage area and some of the components located therein.
Figure 4:
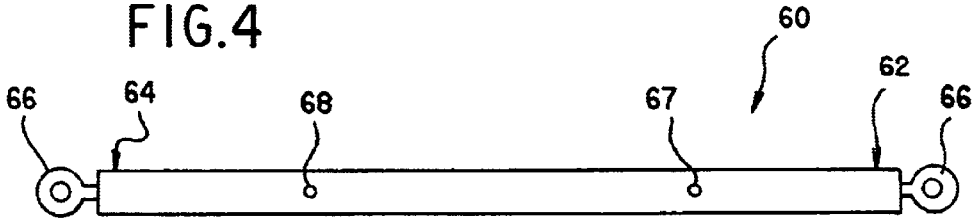
FIG. 4 is a view of the extension bar.
Figure 5:
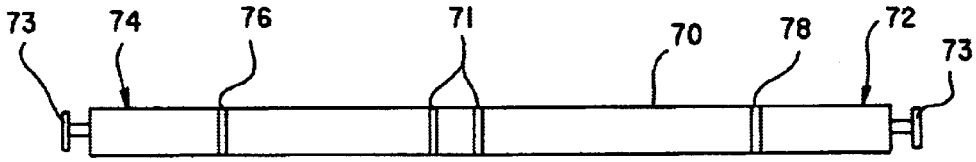
FIG. 5 is a view of the combar.
Figure 6:
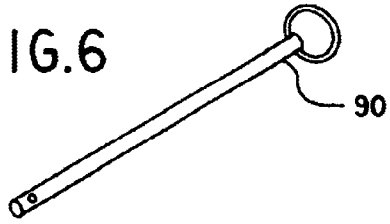
FIG. 6 is a view of a carriage pin.

Referring now to FIGS. 2 and 3, some of the other features of the multipurpose exercise apparatus 10 are shown. A pair of riser elements 25 may be placed under the bottom side 22 to raise the multipurpose exercise apparatus 10. This increases the flexibility of the apparatus 10 and permits different exercises and people of different sizes to easily employ the Target Trainer in their workouts. This particularly would be employed when the user is performing step type exercises.

The forward storage area 30 further holds the extension bar 60, a combar 70, and a wheel 80. The extension bar 60 and combar 70 may be stored parallel to each other and above the wheel 80 in the forward storage area 30. Other materials may be stored in the forward storage area 30. This includes straps and other devices which may permit the elastic resistance elements 102 to be affixed to a human leg, arm, neck, head or the like. A foam pad may also be stored in the forward storage area 30. The foam pad is generally rectangular and is designed to be placed atop the front deck 24 and the rear deck 26. The foam pad increases the comfort of the user while performing exercises. Means to attach the foam pad to the front deck 24 are provided. This attachment means may be a elastic cord or velcro. The pad is stored in the forward storage area 30, where it is retained by an elastic loop.

A first cutout 36A is located on the inside right side 36. A second cutout 38A is located on the inside left side 38. The first cutout 36A is co-linear with the second cutout 38A. The first cutout 36A and the second cutout 38A are designed to receive the combar 70 therein, preventing the front deck 24 from being completely closed. This gives the front deck 24 one additional angle to be set at for exercises. A third cutout 40A is located on the inside front side 40. The third cutout 40A is designed to permit the bar 50 to lie parallel with the bottom side 22 when the front deck 24 is closed.

The combar 70 is an elongated bar which has a right side 72 and a left side 74. A threaded eyelet 75 is secured centrally on the combar 70 on both the right side 72 and the left side 74. A first groove 76 is located proximal the left side 74. A second groove 78 is located proximal the right side 72. A pair of grooves 71 are located centrally on the combar 70. The grooves 76, 78, & 71 are all dimensioned to permit a carabineer to interfit thereon in such a manner which permits rotation of the combar 70 about the carabineer. A pair of end portions 73 are located on the right side 72 and the left side 74 of the combar 70. These end portions 73 permit the power harness 100 to be affixed to the combar 70. The grooves located on the combar 70 further give indication where to place ones hands and or the wheel when being employed.

The extension bar 60 is a second elongated cylindrical bar which has a right side 62 and a left side 64. Both the right side 62 and the left side 64 receive an eye bolt 66 centrally along the centroid of the cylinder. The eye bolt 66 has an opening to receive a carabineer thereon. A first aperture 67 is located on the right side 62 of the extension bar 60. A second aperture 68 is located on the left side 64 of the extension bar 60. The first aperture 67 and the second aperture 68 each receive a carriage pin 90 therein. The carriage pin 90 may be any fastener which meets the dimensional and material requirements. One of the carriage pins 90 are used to secure the front deck 24 in a closed position. Another of the carriage pins 90 are used to secure the rear deck 26 in a closed position. By always having a specific place for the carriage pin 90 and 92 to be located, the chances of misplacing them are reduced.

Close to the front side 20 of the multipurpose exercise apparatus 10 is a place to employ the extension bar 60 in such a manner to permit the user to perform additional exercises. A right aperture 110 is located on the right side 14 proximal the front side 20. A right inner aperture 112 is located in inside right side 36 proximal the inside front side 40. A left inner aperture 114 is located on the inside left side 38 proximal the inside front side 40. A left aperture 116 is located on the left side 16 proximal the front side 20. The right aperture 110, right inner aperture 112, left inner aperture 114, and left aperture 116 are co-linear and receive the extension bar 60 there through. When the extension bar 60 is placed in the co-linear apertures (110, 112, 114, 116) the first aperture 67 of the extension bar 60 and the second aperture 68 of the extension bar 60 are located outside the right side 14 and the left side 16. The first aperture 67 and second aperture 68 of the extension bar 60 then receive the carriage pins 90 therein, securing the extension bar 60 in the co-linear apertures (110, 112, 114, 116). The eye bolts 66 of the extension bar 60 are then able to have the power harness 100 affixed thereto. In addition, when the power harness 100 is connected to the ring clips 34 proximal the front side, the elastic resistance elements 102 may pass underneath the extension bar 60. This shortens the length of the elastic resistance elements 102, increasing the amount of force required to perform an exercise.

Figure 7:
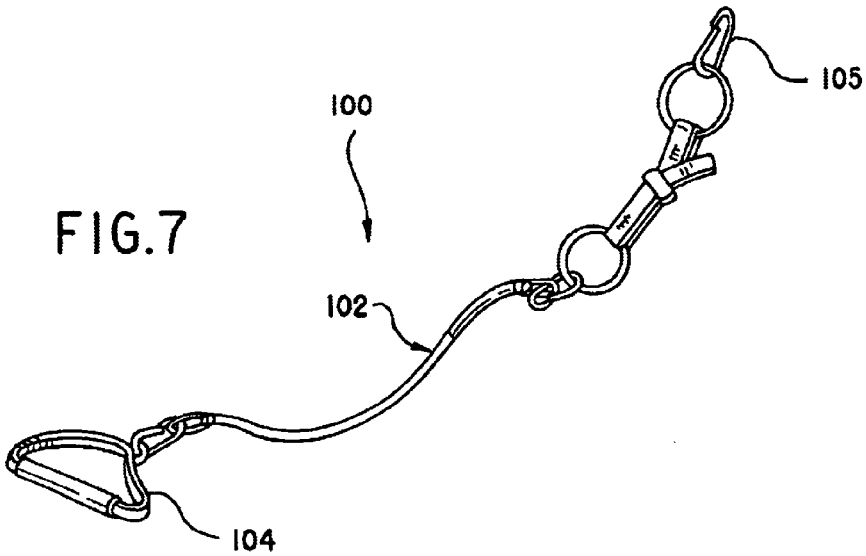
FIG. 7 is a view of the power harness.

Referring now to FIG. 7, a power harness 100 is shown. The power harness 100 includes an attachment means 105 on a first side. This attachment means 105 may be chosen to be a carabineer coupled with a trigger clip. In this application, the carabineer is used to designate a user actuated attachment device, which may be spring activated. There is an entire group of such devices which may be used, any attachment means with the appropriate material properties may be employed. The user merely opens the attachment means 105 (carabineer, locking clip, spring clip, or the like) and attaches it to a ring clip 34 or the eye bolt 66 of the extension bar 60. The power harness 100 includes a handle 104 on a second side. Intermediate the attachment means 105 and the handle 104 is an elastic resistance element 102. The elastic resistance elements 102 are removably affixed to the carabineer which in turn is attached to the trigger clip.

The elastic resistance element 102 may be color coded as well which would indicate elasticity. The greater the elasticity of the elastic resistance element 102, the less the force would be required to stretch the elastic resistance element 102 a first distance. The less the elasticity of the elastic resistance element 102 the greater the force would be required to stretch the elastic resistance element 102 a first distance. The elastic resistance element 102 may be rubber tubing, bungee cord or the like.

It can clearly be seen that the power harness 100 may be of any of a variety of configurations which include, but are not limited to, attachment rings, attachment clips, loops, means to adjust length, straps, carabineer style links, other linkages, and the like. More than one elastic resistance element 102 may be employed to increase the resistance. Each elastic resistance element has a attachment ring located on each side. The attachment rings are mated with clip attachment devices which on one side will be affixed to a handle at the handle attachment point, and on the other side may be affixed to a ring. The ring would be attached to a second ring by a strap, the strap may be adjustable for length. The second ring has a carabineer affixed thereto, this is the attachment means 105. Further, a device such as a trigger clip may be affixed to the carabineer as the attachment means 105. It has been found that such trigger clips work well when attaching to the ring clips 34.

FIG. 8 shows the multipurpose exercise apparatus 10 in its closed position. The front deck 24 is shown in relation to the rear deck 26.

FIG. 9 shows a user performing an exercise on the apparatus 10. Note how the combar 70 is connected to the extension bar 60 by the elastic resistance elements 102. The elastic resistance elements 102 are connected to the extension bar 60 by a power harness connection means 105. The elastic resistance elements 102 are connected to the combar 70 by a second power harness connection means 106. The power harness connection means (105, 106) includes carabineer and trigger clip elements. Any clip style connection device with sufficient material properties and configuration may be used to connect the power harness 100 to the combar and extension bar. (And for that matter, the ring clips 34).

Figure 10:
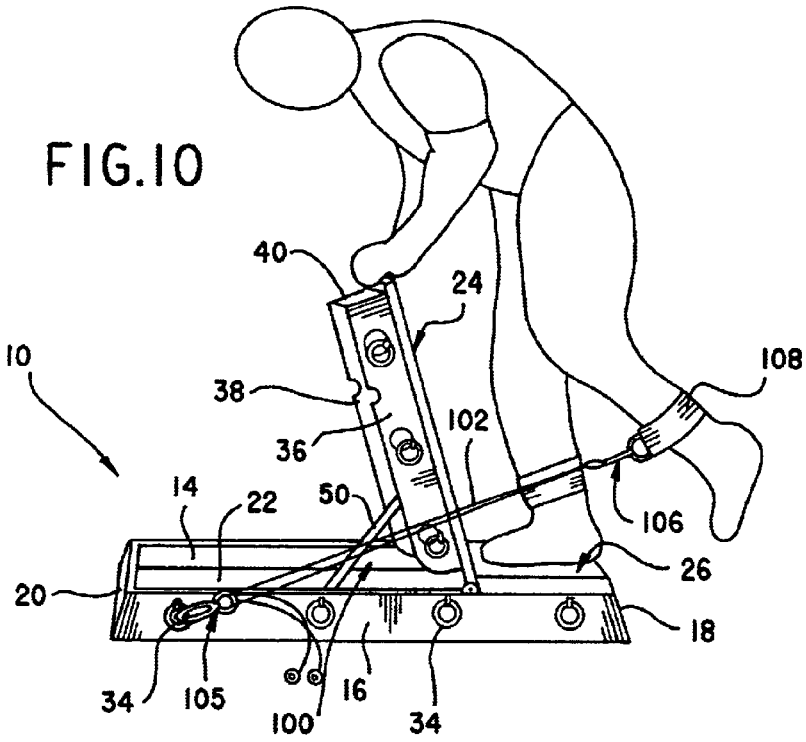
FIG. 10 shows a user performing an exercise involving the ankle harness and the power harness.

FIG. 10 shows a user performing another exercise on the apparatus 10. In this exercise the power harness 100 is connected to a leg attachment harness 108 and a ring clip 34. A first power harness connection means 105 is secured to a ring clip 34 proximal the front side 20. A second power harness connection means 106 is connected to the leg attachment harness 108. The leg attachment harness 108 is attached to the users leg. The user is supported by the front deck 24. It is clear from this figure that any of a variety of exercises may be developed through the use of the leg attachment harness 108. Although not shown, other harness devices for affixing the power harness 100 to an arm, the head, or another ancillary mechanisms may be utilized.

Figure 11:
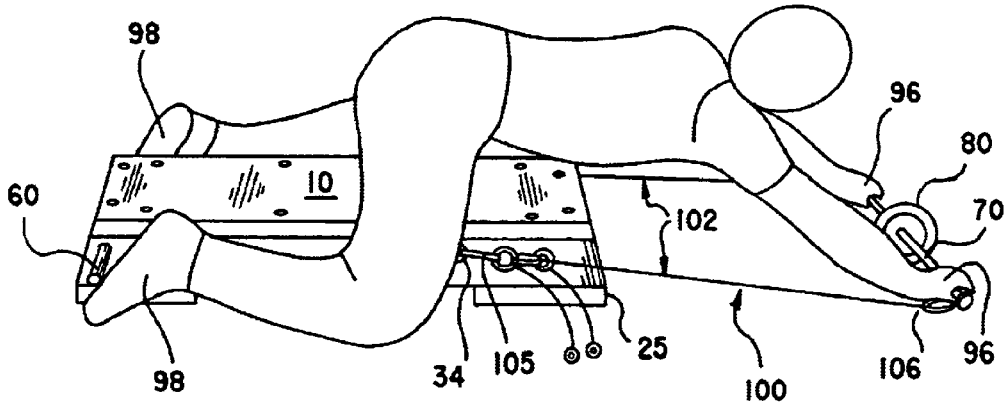
FIG. 11 shows a user performing an exercise involving the wheel and the combar.

FIG. 11 shows a user performing yet another exercise on the apparatus 10. The wheel 80 is placed in the center of the combar 70. The extension bar 60 is placed in and secured by carriage pins 90 in apertures 110, 112, 114 and 116. The power harness 100 is connected to the ring clip 34 by a first power harness connection means 105. The power harness 100 is connected to the combar 70 on the end portions of the combar 73 by the second power harness connection means 106. The user places their feet 98 on the extension bar 60, places their hands 96 on the combar, and rolls the wheel 80 from a first position to a second position, with the elastic resistance elements 102 providing resistance. This is an abdominal roller style workout. It is clear from this figure that any of a variety of exercises may be developed through the use of the extension bar 60, the combar 70 and the wheel 80.

In my previous patent, U.S. Pat. No. 6,245,001, a variety of other exercises are shown, especially in FIGS. 6, 7, 8, & 9. These exercises can easily be shown on the improved multipurpose exercise apparatus 10.

It is apparent from the above that the present invention accomplishes all of the objectives set forth by providing a multipurpose exercise device which includes resistive elements which are affixed to any of a plurality of ring clips and other connection points provided on a multitude of accessories permitting any of a variety of exercises to be performed.

With respect to the above description, it should be realized that the optimum dimensional relationships for the parts of the invention, to include variations in size, materials, shape, form, function and manner of operation, assembly and use, are deemed readily apparent and obvious to those skilled in the art, and therefore, all relationships equivalent to those illustrated in the drawings and described in the specification are intended to be encompassed only by the scope of appended claims.

While the present invention has been shown in the drawings and fully described above with particularity and detail in connection with what is presently deemed to be the invention, it will be apparent to those of ordinary skill in the art that many modifications thereof may be made without departing from the principles and concepts set forth herein. Hence, the proper scope of the present invention should be determined only by the broadest interpretation of the appended claims so as to encompass all such modifications and equivalents.

What is claimed as being new and desired to be protected by Letters Patent of the United States is as follows:

1. A multipurpose exercise apparatus comprising:

a generally trapezoidally shaped main body having a first end, a second end, a first side, a second side, a bottom, and a top, said main body having a longitudinal axis, said longitudinal axis being parallel to said first side and said second side;

said top including a hinge means, said hinge means located perpendicular to said longitudinal axis, said hinge means defining a first storage section proximate said first end of said main body and a second storage section proximate said second end of said main body;

said hinge means further dividing said top into a forward section top and a rearward section top such that either said forward section top or said rearward section top can be moved radially about said hinge means to provide access to either said first storage section or said second storage section;

said main section top including a depending lip, said depending lip nested in said main body, a plurality of elastic resistive elements;

a plurality of ring clips on said first side of said main body and said second side of said main body and on said depending lip; and detachable engagement means for attaching said elastic resistive elements to said ring clips; whereby a user attaches said elastic resistive elements to said ring clips on said main body and by choosing predetermined of said ring clips, may perform a variety of exercises.

2. A multipurpose exercise apparatus as claimed in 1 wherein said forward section top is maintained in an open position by a first bar, and said rearward section top is maintained in an open position by a seat riser.

3. A multipurpose exercise apparatus as claimed in claim 2 wherein said first storage area is larger than the second storage area.

4. A multipurpose exercise apparatus as claimed in claim 3 wherein said first storage area includes an extension bar, a combar and a wheel.

5. A multipurpose exercise apparatus as claimed in claim 4 wherein said second storage area includes a power harness.

6. A multipurpose exercise apparatus as claimed in claim 1 wherein said ring clips are recessed.

7. A multipurpose exercise apparatus as claimed in claim 6 wherein each said recess is chosen to be a color.

8. A multipurpose exercise apparatus as claimed in claim 7 wherein said top includes a perimeter, further, said top includes a plurality of tab elements located about said perimeter, said plurality of tab elements are proximal said recesses, said plurality of tab elements chosen to be the same color of said recess closest thereto, indicating to the user the color of the recess when the user looks down.

9. A multipurpose exercise apparatus as claimed in claim 4 wherein a plurality of co-linear apertures are located proximal the end of the first storage area, penetrating said right side, said left side and said depending lip, said apertures designed to receive said extension bar therethrough.

10. A multipurpose exercise apparatus comprising:

a generally trapezoidally shaped main body having a first end, a second end, a first side, a second side, a bottom, and a top, said main body having a longitudinal axis, said longitudinal axis being parallel to said first side and said second side;

said top including a hinge means, said hinge means located perpendicular to said longitudinal axis, said hinge means defining a first storage section proximate said first end of said main body and a second storage section proximate said second end of said main body;

said hinge means further dividing said top into a forward section top and a rearward section top such that either said forward section top or said rearward section top can be moved radially about said hinge means to provide access to either said first storage section or said second storage section;

a plurality of elastic resistive elements;

a plurality of ring clips on said first side of said main body and said second side of said main body; and detachable engagement means for attaching said elastic resistive elements to said ring clips; whereby a user attaches said elastic resistive elements to said ring clips on said main body and by choosing predetermined of said ring clips, may perform a variety of exercises.

11. A multipurpose exercise apparatus according to claim 10 wherein a plurality of ring clips are additionally located on said first end and said second end of said main body.

12. A multipurpose exercise apparatus as claimed in claim 11 wherein said first storage area includes an extension bar, a combar and a wheel.

13. A multipurpose exercise apparatus as claimed in claim 11 including a power harness, said power harness includes a first connection means, a second connection means, a resistive elastic element intermediate said first connection means and said second connection means.

14. A multipurpose exercise apparatus as claimed in claim 13 wherein said first connection means may be connected to any one of said clip rings, said extension bar and said combar.

15. A multipurpose exercise apparatus as claimed in claim 14 wherein said second connection means may be connected to a handle, a ankle attachment means, a leg attachment means, said extension bar and said combar.

* * * * *